US007034230B2

(12) United States Patent
Fan

(10) Patent No.: US 7,034,230 B2
(45) Date of Patent: Apr. 25, 2006

(54) FLEXIBLE LED CABLE LIGHT

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 11/111,902

(22) Filed: Apr. 22, 2005

(65) Prior Publication Data

US 2005/0180162 A1 Aug. 18, 2005

Related U.S. Application Data

(62) Division of application No. 10/694,859, filed on Oct. 29, 2003, now Pat. No. 6,914,194.

(51) Int. Cl.
*H01B 7/08* (2006.01)

(52) U.S. Cl. ..... 174/117 F

(58) Field of Classification Search ..... 174/117 F, 174/117 FF, 48; 439/590, 885
See application file for complete search history.

(56) References Cited

U.S. PATENT DOCUMENTS

| | | | |
|---|---|---|---|
| 4,631,650 | A | 12/1986 | Ahroni |
| 5,330,368 | A | 7/1994 | Tsuruzono |
| 5,967,841 | A | 10/1999 | Bianca et al. |
| 6,660,935 | B1 | 12/2003 | Southard et al. |
| 2003/0168247 | A1 | 9/2003 | Schreck et al. |

*Primary Examiner*—Chau Nguyen N.
(74) *Attorney, Agent, or Firm*—Rosenberg, Klein & Lee

(57) ABSTRACT

A flexible LED cable light has a flat insulation body, at least two wires embedded in parallel in the insulation body, multiple LEDs connected in parallel electrically to the two wires and a protective layer covering the insulation body. Each wire has high flexibility, good conductivity and large current-resistant that is suitable to decorate over long distances. Furthermore, segments of the cable light can also be connected to another segment by a connector so the present invention is waterproof, inexpensive, cuttable, joinable, etc.

10 Claims, 12 Drawing Sheets

FLEXIBLE LED CABLE LIGHT

CROSS-REFERENCE

This application is a divisional application of U.S. application Ser. No. 10/694,859, filed Oct. 29, 2003, now U.S. Pat. No. 6,914,194.

BACKGROUND OF THE INVENTION

1. Field of the Invention

The present invention relates to a flexible LED illumination device, and more particularly to an improved flexible LED cable light.

2. Description of Related Art

LED cable lights have high brightness and low power consumption so they are usually decorative lights for houses, offices, stories, etc. Furthermore, the LED cable light is flexible so the LED cable light is easy to store and decorate curved places and is even portable. To decorate large exterior walls of buildings, the LED cable light must be waterproof, low cost, cuttable or joinable, etc.

To meet the forgoing requirements many types of LED cable lights have been developed. With reference to FIG. 14, a first type of conventional LED cable light has a pair of wires (20, 21), multiple LED chips (22) and an epoxy sheath (23). The wires (20, 21) are connected to low power source (not shown). Each LED chips (22) is connected between the pair of wires (20, 21), and the epoxy sheath (23) covers the pair of wires (20, 21) and the LED chips (22). Therefore, the first type of conventional LED cable light is waterproof function but cannot be cut or joined easily. Therefore, the first type of conventional LED cable light does not completely meets the forgoing requirements.

With reference to FIG. 15, a second type of conventional LED cable light includes an insulator substrate (25), wires (not shown) and LEDs (26). The wires are on the insulator substrate (25), and the LEDs (26) are connected to the wires. The wires are usually made of aluminum, gold etc. The wires are expensive material so the second type of conventional LED cable light is not cheap. Furthermore, the second type of conventional LED cable light does not have a joinable structure or connector so the cable light does not meet the necessary requirements.

With reference to FIG. 16, a third type of conventional LED cable light has a multi-layer substrate (27), conductors (28), LEDs (29), spacers (50) and lenses (51). The multi-layer substrate (27) has two opposite sides (not numbered), and the LEDs (29) and the two conductors (28) are mounted on the multi-layer substrate (27). The LEDs are connected to the two conductors (28), and the lenses are mounted across the two opposite sides to cover the LEDs and the two conductors (28). The third type of conventional LED cable light can be cut different lengths but has a very complex structure. Consequently, the fabricating cost of the third type of conventional LED cable light is higher than the other types described. Therefore, the third type does not meet the forgoing requirements either.

With reference to FIG. 17, a fourth type of conventional LED cable light includes an insulation layer (52), conductors (53) and LEDs (54). The conductors (53) are embedded in the insulation layer (52). Each LED (54) has two contacts (541) that puncture the insulation layer (52) and connects to the conductors (53). The fourth type of conventional LED cable light has a simple structure so the cable light is easy to fabricate and the cost is cheap. However, the fourth type of conventional LED cable light is not very waterproof because the contacts (541) of the LED (54) puncture the insulation layer (52). Therefore, the fourth type of conventional LED cable light does not meet the necessary requirements.

With reference to FIG. 18, a fifth type of conventional LED cable light has a substrate strip (55), a printed circuit (551), surface mounted technology (SMT) LEDs (56) and an insulation layer (57). The printed circuit (551) is formed on the substrate strip (55). The SMT LEDs (56) are connected to the printed circuit (551), and the insulation layer (57) covers the substrate strip (55), the printed circuit (551) and LEDs (56). The LEDs (56) are connected to the printed circuit (551) so the substrate strip (55) having the printed circuit (551) must be required. Therefore, the fifth type of conventional LED cable light has complex fabricating process and has a relatively high cost.

The conventional LED cable lights either are not waterproof or affordable or cannot be easily cut and joined. Therefore, the present invention provides a flexible LED cable light to achieve the aforementioned features.

SUMMARY OF THE INVENTION

The main objective of the invention is to provide a flexible LED cable light that is waterproof, affordable, cuttable, joinable, etc.

In accordance with the present invention, an LED cable light includes an insulation body having a longitudinal slot and multiple vertical notches to respectively communicate with the longitudinal slot, at least two wires of multiple strands, a plurality of LEDs respectively mounted on circuit boards and a protective layer. The at least two wires are embedded in parallel in the insulation body, and the LEDs mounted on the circuit boards are respectively received in a corresponding one of the notches and connected to the at least two wires by conductors. The LEDs can further connect in serial to resistors received in the longitudinal slot to form multiple strings. The LEDs or strings are electrically connected in parallel to the two wires. The LEDs used in the present invention refer to the three types such as SMT LEDs, LED bare chips and sealed cube LEDs.

Other objectives, advantages and novel features of the invention will become more apparent from the following detailed description when taken in conjunction with the accompanying drawings.

DETAILED DESCRIPTION OF THE PREFERRED EMBODIMENT

An LED cable light in accordance with the present invention has a flat insulation body, at least two wires of multiple strands, multiple LEDs and a protective layer.

Figure 1:
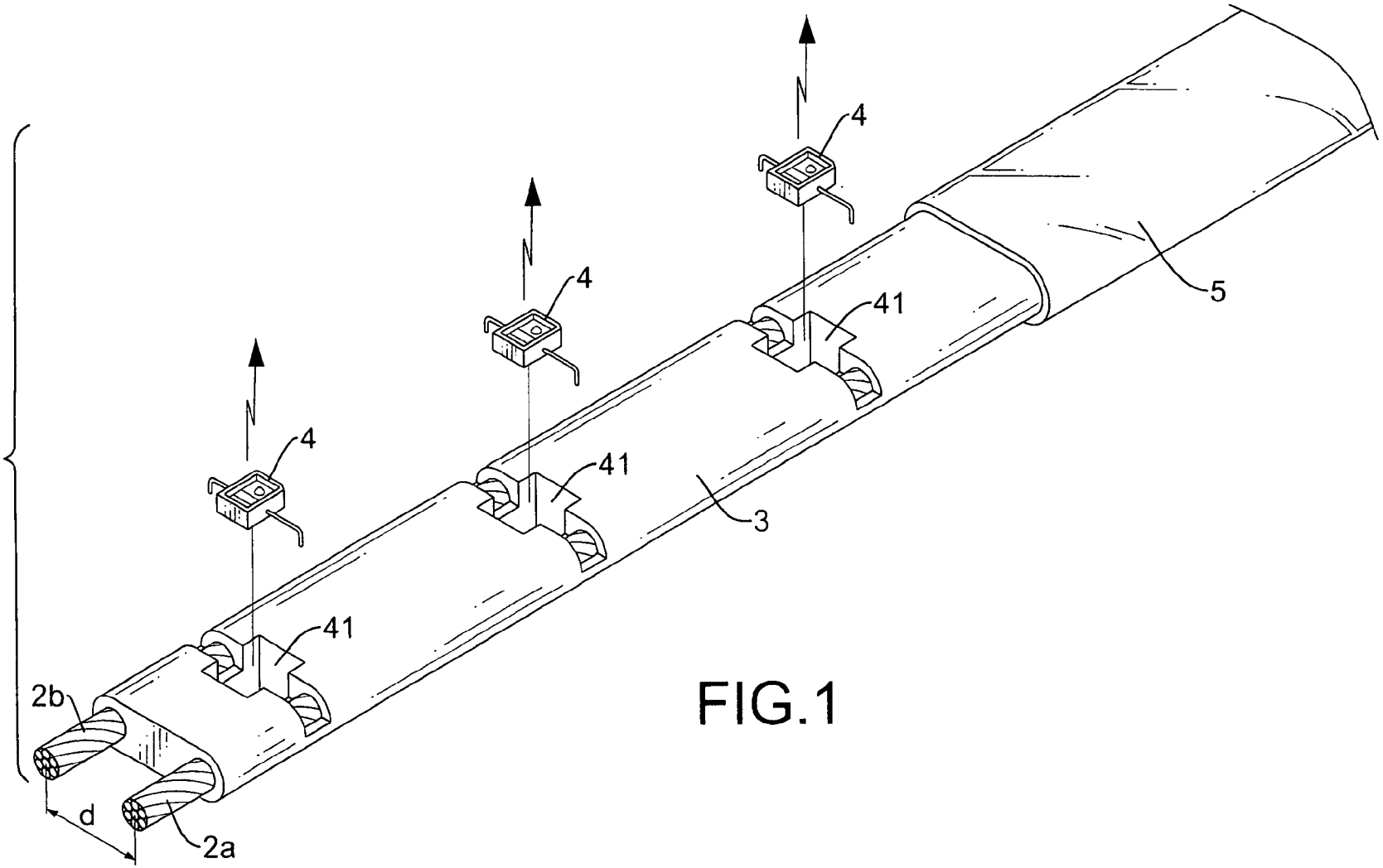
FIG. 1 is an exploded perspective view in partial section a first embodiment of an LED cable light in accordance with the present invention.

With reference to FIG. 1, a first embodiment of the flexible LED cable light has an insulation body (3), two wires (2*a*, 2*b*), multiple LEDs (4) and a protective layer (5).

Each LED is a surface-mounted technology (SMT) package LED (4) and has a driving voltage that is about 2.1V to 4.0V The two wires (2*a*, 2*b*) are embedded parallel in the insulation body (3) and a specific distance (d) existed between the two wires (2*a*, 2*b*). The insulation body (3) has a series of multiple individual notches (41). Each notch (41) has a depth that is deeper than that the wires (2*a*, 2*b*) are embedded, so the two wires (2*a*, 2*b*) are exposed to electronically connect to the LED. The notches (41) are slightly larger than the LEDs (4) so the LEDs (4) are mounted respectively in the notches (41) and are electrically connected in parallel to the two wires (2*a*, 2*b*). The LEDs (4) are electrically connected to the wires (2*a*, 2*b*) by soldering or forming two prongs (not numbered) to insert into the wires (2*a*, 2*b*). The protective layer (5) covers the insulation body (3), the notches (41), the LEDs (4) and the exposed wires (2*a*, 2*b*). The protective layer (5) is made of polyvinyl chloride (PVC) material. The protective layer (5) is made of transparent or semi-transparent material.

Figure 2:
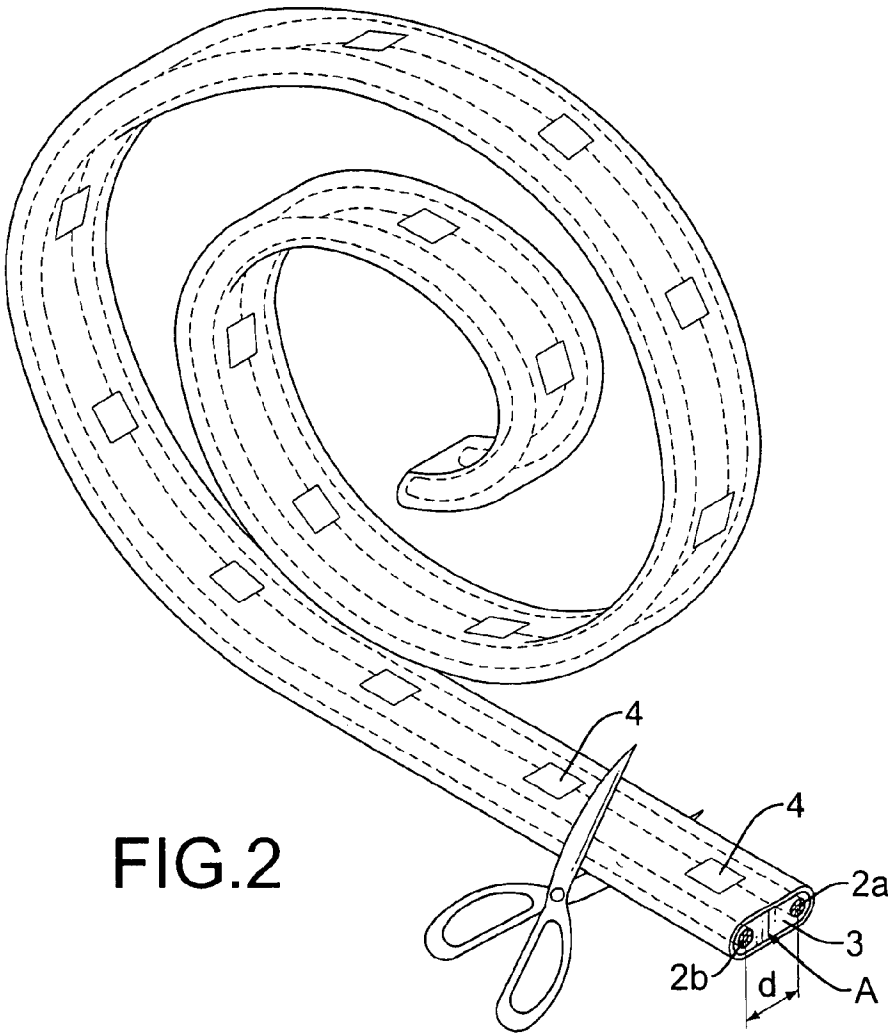
FIG. 2 is an operational perspective view of the LED cable light in FIG. 1.

With reference to FIG. 2, the multiple LEDs (4) are connected in parallel to the two wires (2*a*, 2*b*) so the LED cable light can be cut to desired lengths. The insulation body (3) with the wires (2*a*, 2*b*) of multiple stands is extremely flexible has good conductivity, large current-resistant, etc. The insulation body (3) has a lateral cross sectional area (A) of 6 mm×2 mm, and each wire (2*a*, 2*b*) has a diameter that is about 0.127 mm to 0.254 mm. The specific distance (d) between the two wires is 4 mm.

Figure 3:
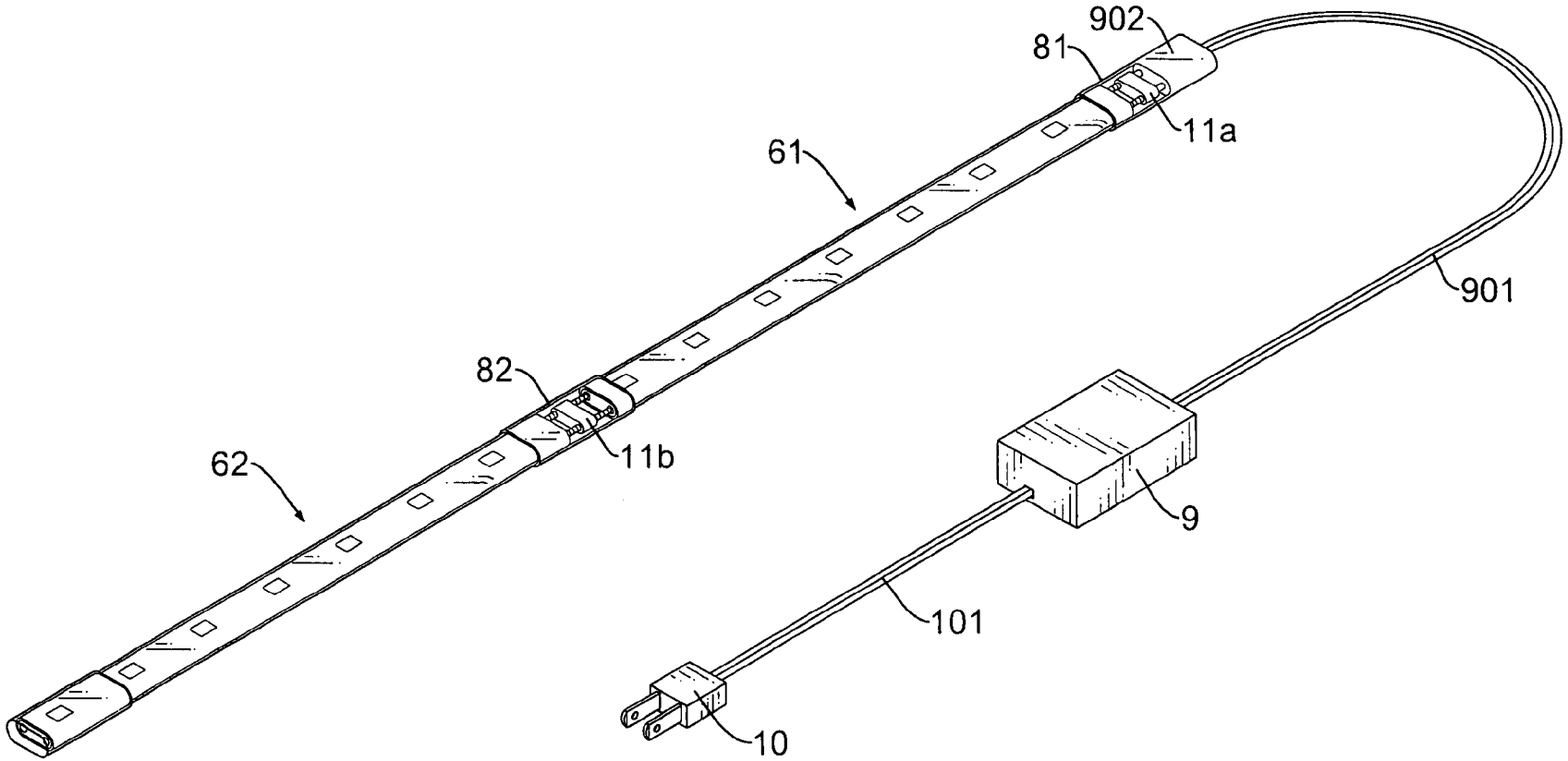
FIG. 3 is a perspective view of the LED cable light in FIG. 1 connected to a power source.
Figure 4:
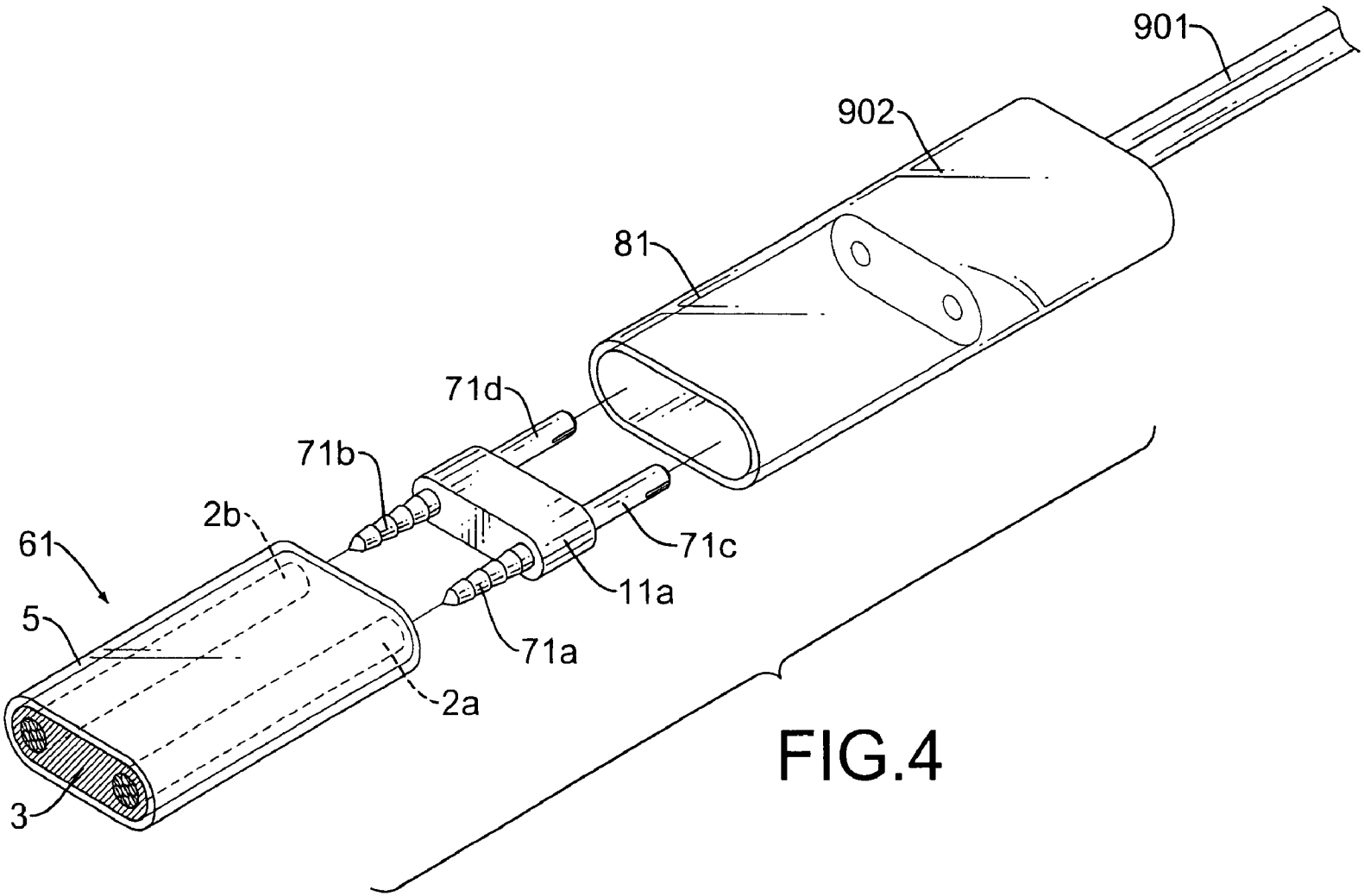
FIG. 4 is an enlarged exploded perspective view in partial section of the LED cable light and a connector to a power source in FIG. 3.

With reference to FIG. 3, the first embodiment of the LED cable light is connected to a power source. The LED cable light is optionally connected to the power source through a power adapter (not numbered). The power adapter has a power transformer (9) having power output and power input, a plug (10), a socke (902), a conductor (not numbered) and two power lines (101, 901). The plug (10) is connected to the power input of the power transformer (9) through one power line (101), and the socket (902) is connected to the power output of the power transformer through the other power line (901). With further reference to FIG. 4, the conductor has a plastic base (11*a*), two power prongs (71*c*, 71*d*) and two awl-shaped prongs (71*a*, 71*b*) with sharp points (not numbered). The plastic base (11*a*) has two opposite ends (not numbered). The two power prongs (71*c*, 71*d*) are mounted on one end of the plastic base (11*a*), and the two awl-shaped prongs (71*a*, 71*b*) are mounted on the other end of the plastic base (11*a*). The power prongs (71*c*, 71*d*) are inserted into the socket (902), and the two awl-shaped prongs (71*a*, 71*b*) are connected to the two wires (2*a*, 2*b*) in the insulation body (3). A joint between the plastic base (11*a*) and protective layer (5) can be sealed by glue (not shown) and further covered by a tube (81).

Figure 5:
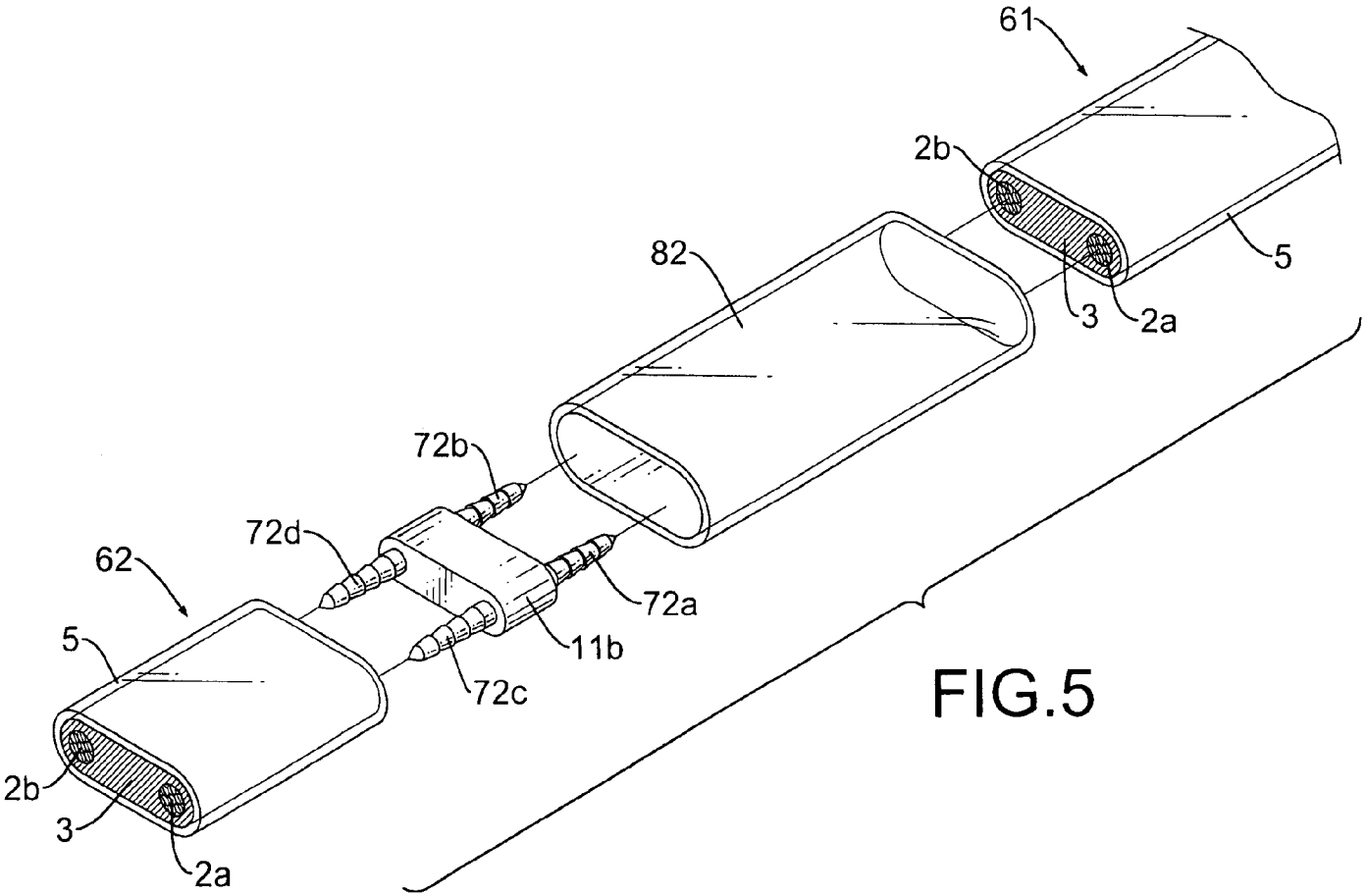
FIG. 5 is an enlarged exploded perspective view in partial section of a connector between segments of the LED cable light in FIG. 3.

With reference to FIGS. 3 and 5, the LED cable lights are joinable. Two segments (61, 62) of the LED cable lights are connected together by a connector (not numbered). The connector is composed of a plastic base (11*b*) having two opposite ends, two first awl-shaped prongs (72*a*, 72*b*) with sharp points (not numbered) and two second awl-shaped prongs (72*c*, 72*d*) with sharp points (not numbered). The first and second awl-shaped prongs (72*a*, 72*b*, 72*c*, 72*d*) are mounted respectively on the two ends. The first awl-shaped prongs (72*a*, 72*b*) are pushed into the two wires (2*a*, 2*b*) in the insulation body (3) of the one segment (61) and the second awl-shaped prongs (72*c*, 72*d*) are pushed into the two wires in the insulation body (3) of the other segment (62) to complete the joint of the two segments (61, 62). The joint between the plastic base (11*b*) and the two protective layers (5) can be sealed by glue (not shown) and further covered by a tube (82), such arrangement can make the LED cable light an absolute waterproof capability.

Figure 6:
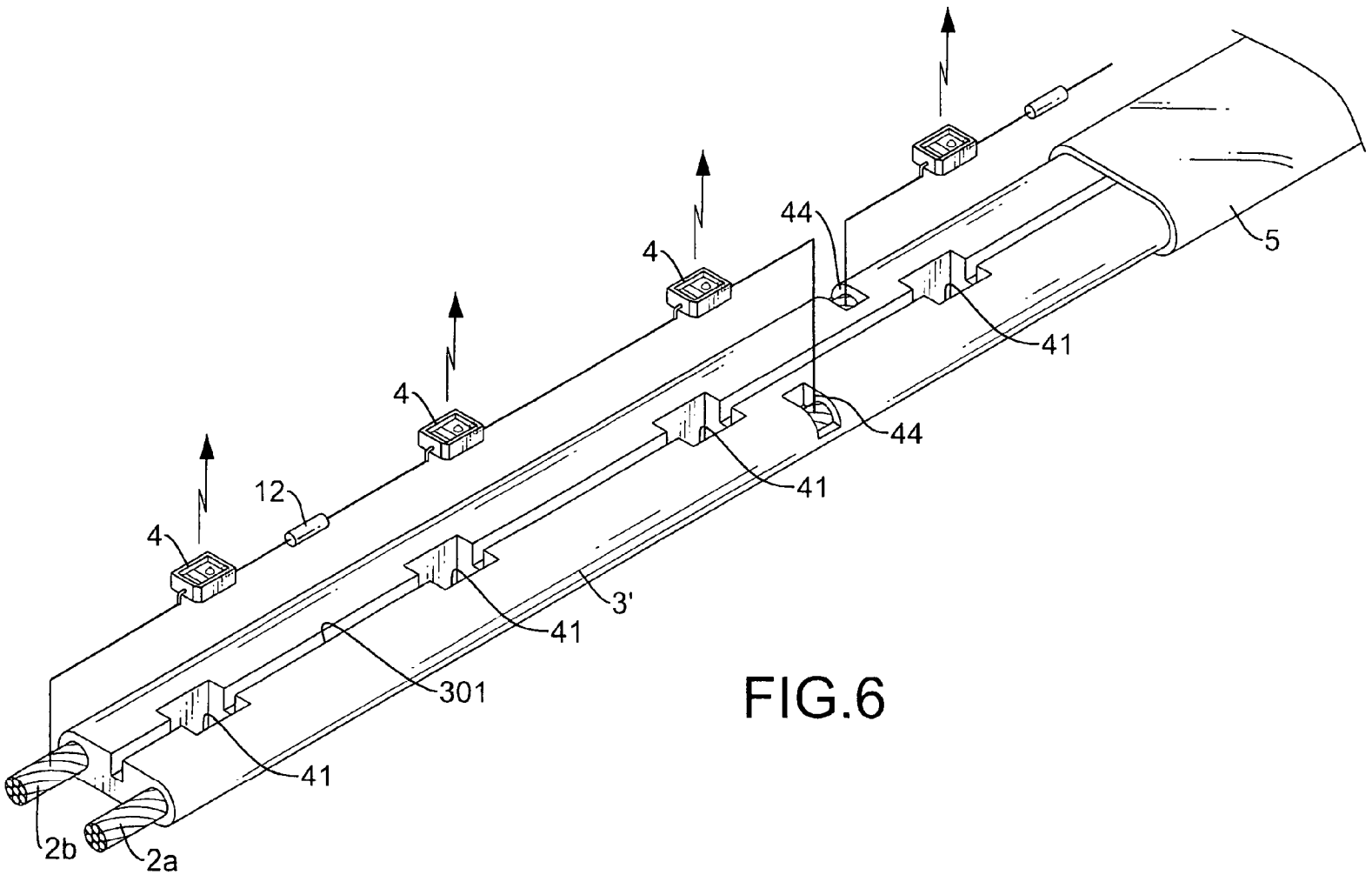
FIG. 6 is a perspective view of a second embodiment of an LED cable light in multiple strings pulled up condition in accordance with the present invention.

With reference to FIG. 6, a second embodiment of the LED cable lights in accordance with the present invention is similar to the first embodiment. The second embodiment has a flat insulation body (3'), two wires (2*a*, 2*b*), multiple LEDs (4) and a protective layer (5).

The multiple LEDs (4) are connected to form multiple strings each comprising a plurality of LEDs (4). Each string of LEDs (4) has at least one resistor (12) connected to the LEDs (4) of the string in serial.

The insulation body (3) has multiple individual notches (41) that are arranged in one row, multiple pairs of holes (44) and a narrow longitudinal slot (301). The pairs of holes (44) correspond respectively to two terminals of the strings. The narrow longitudinal slot (301) communicates with the row of multiple individual notches (41). Each notch (41) has a width that is narrower than the specific distance (d) between the two wires (2*a*, 2*b*), so the two wires (2*a*, 2*b*) are not exposed by the longitudinal slot (301) or the row of individual notches (41). Each resistor (12) is smaller than the LEDs (4) so the resistors (12) can be mounted in the longitudinal slot (301). Each pair of holes (44) is defined in the insulation body (3), and the holes (44) in each pair align respectively with the two wires (2*a*, 2*b*). Therefore, the two wires (2*a*, 2*b*) are exposed at the holes (44).

The two terminals of each string are connected to the two wires (2*a*, 2*b*) through the pair of holes (44). Therefore, each light unit is connected in parallel electrically to the two wires (2*a*, 2*b*). Each string is composed of LEDs (4) and resistors (12) so voltage to drive each string is increased. That is, the two wires (2*a*, 2*b*) can be connected to larger power source without the power transformer (not shown). For example, the driving voltage of each light unit can be 12V, 24V, 120V, 240V, etc.

Figure 7:
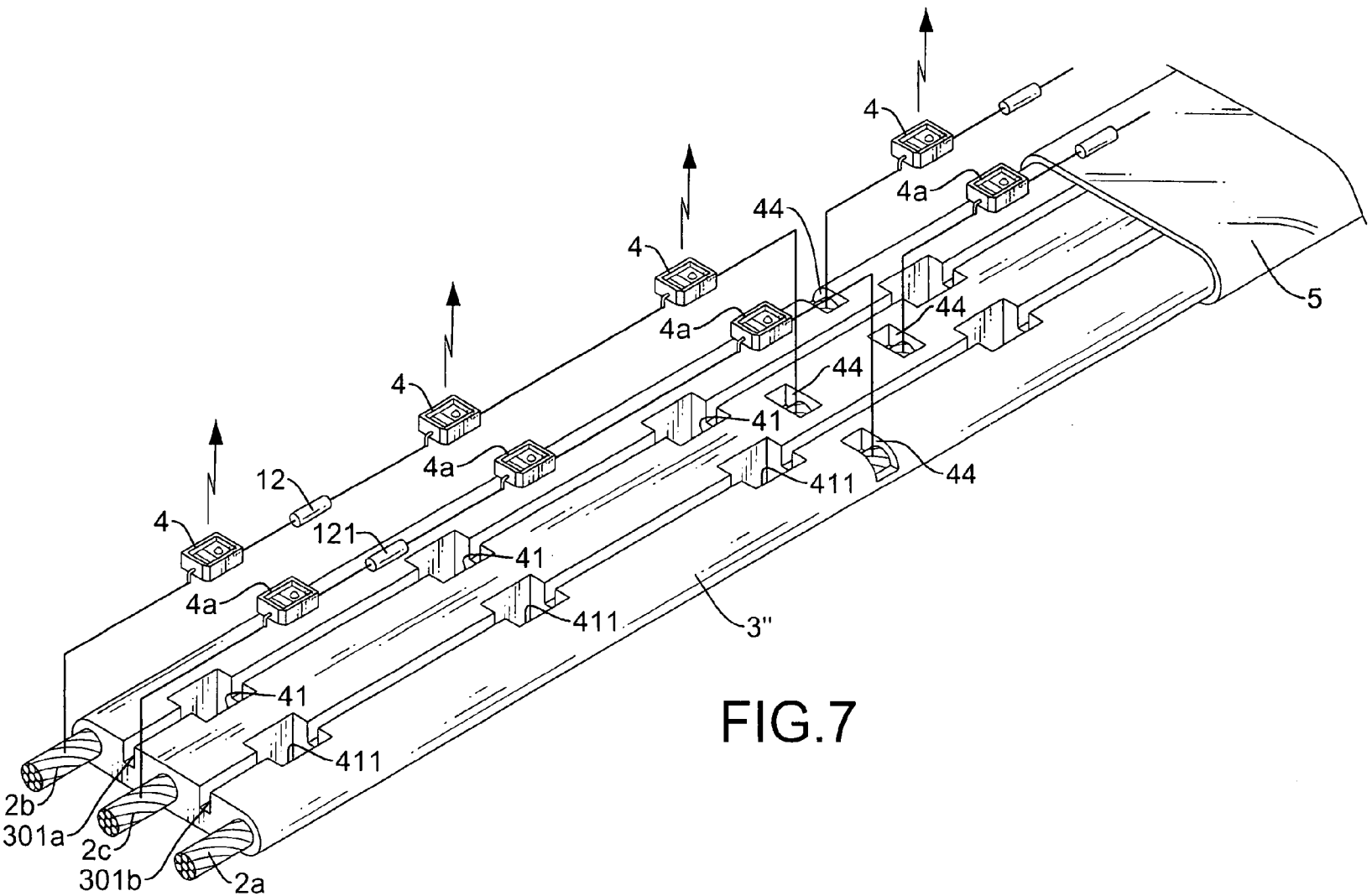
FIG. 7 is a perspective view of a third embodiment of an LED cable light in multiple strings pulled up in accordance with the present invention.

With reference to FIG. 7, a third embodiment of LED cable light in accordance with the present invention is similar to the second embodiment. The third embodiment has a flat insulation body (3"), three wires (2*a*, 2*b*, 2*c*), multiple strings (not numbered) and a protective layer (5).

The three wires (2*a*, 2*b*, 2*c*) are embedded in parallel in the insulation body (3"). The insulation body (3") defines two rows of multiple individual notches (41,411), multiple pairs of holes (44) and two narrow longitudinal slots (301*a*, 301*b*). Each pair of holes (44) is defined on the insulation body (3"), and the holes (44) in each pair align respectively with adjacent wires (2*a*, 2*b*, 2*c*). The two narrow longitudinal slots (301*a*, 301*b*) are respectively communicated with the corresponding the two row of individual notches (41, 411). Each string is composed of multiple LEDs (4,4*a*) and resistors (12,121) in series and has two terminals. The multiple light units are connected in parallel respectively to adjacent wires (2*a*, 2*b*, 2*c*).

Figures 8, 9:
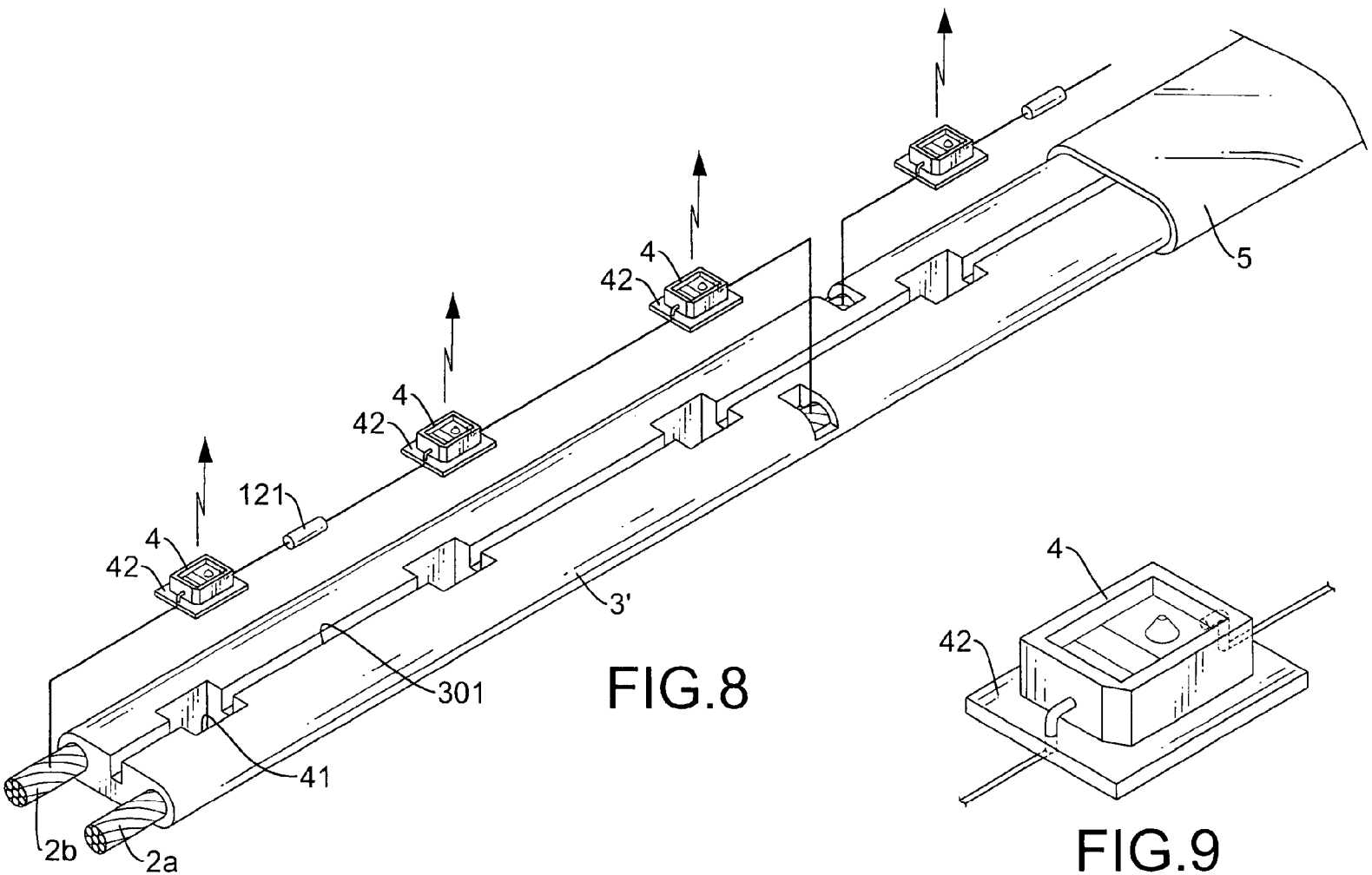
FIG. 8 is a perspective view of the second embodiment of an LED cable light using surface-mounted technology (SMT) packaged LEDs which are pulled up.
FIG. 9 is an enlarged perspective view of one SMT packaged LEDs mounted on a circuit board in FIG. 8.

With reference to FIG. 9, the SMT package LEDs are further respectively mounted on circuit board (42). With further reference to FIG. 8, the second embodiment of the LED cable light uses the multiple SMT package LEDs (4) on the circuit boards (42). The SMT package LEDs are connected to form multiple strings each comprising a plurality of SMT package LEDs (4). Each string of LEDs has at least one resistor (121) connected to the LEDs of string in serial, and then is electrically connected to the at least two wires (2*a*, 2*b*) in parallel.

The SMT package LEDs (4) are respectively received in a corresponding one of the multiple notches (41) and the resistors (121) are received in the longitudinal slot (301). The SMT LED (4) being moldered on the circuit board (42) and the application of the protective layer (5), so the LED cable light of the present invention can be free for folding and bending without damage of the electrical connection between the SMT package LEDs (4).

Figures 10, 11:
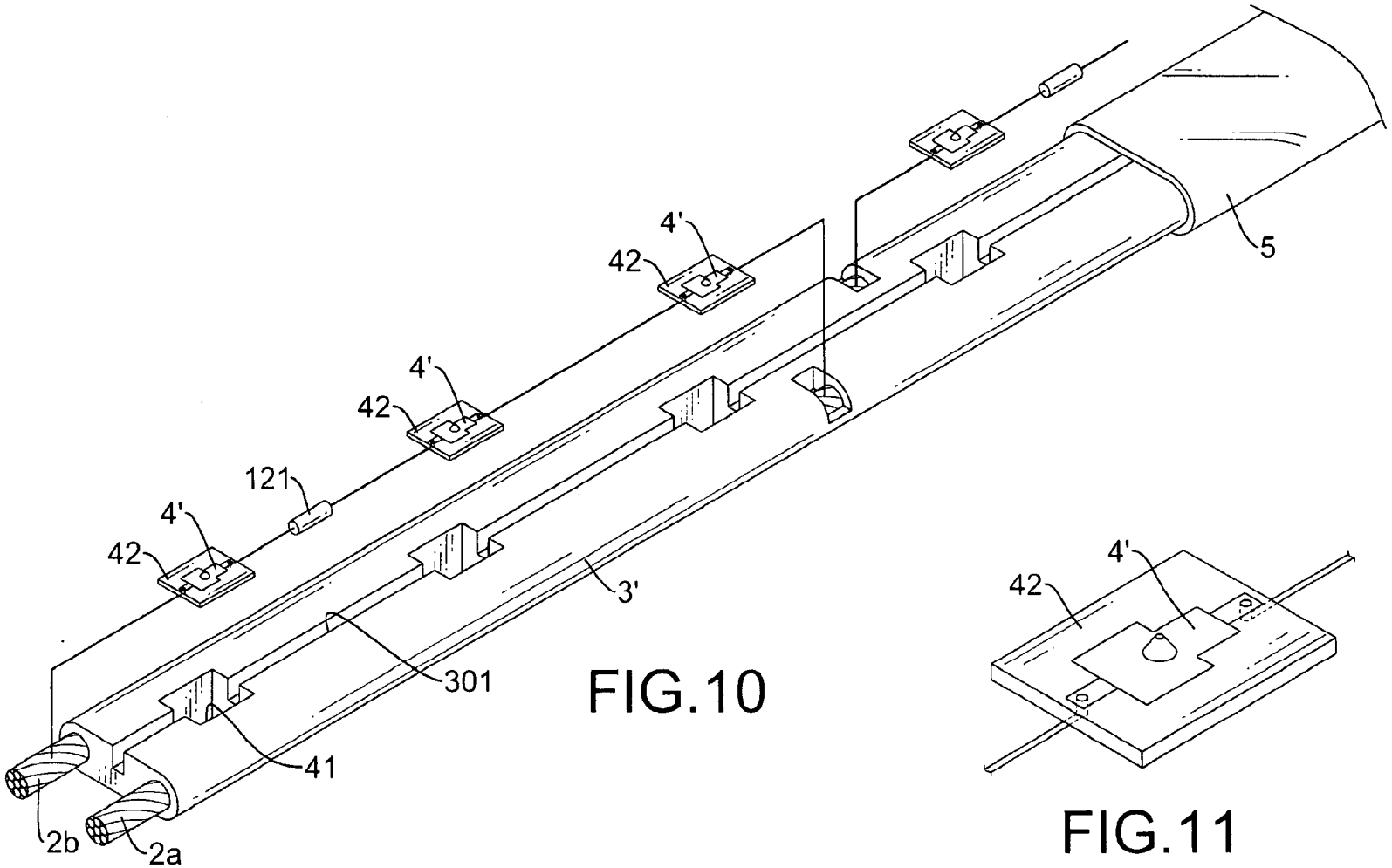
FIG. 10 is a perspective view of the second embodiment of an LED cable light using LED bare chips which are pulled up.
FIG. 11 is an enlarged perspective view of one LED bare chip and one circuit board in FIG. 10.

With reference to FIG. 11, the second embodiment of the present invention uses another type of the LEDs. The LED is an LED bare chip (4') the LED bare chips (4') are respectively mounted on circuit boards (42). The method of mounting LED bare chips (4') directly on a circuit board (42) is known in the art, so such arrangement can make a much cheaper and smaller light device. FIG. 10 illustrate the cable light of the present invention uses the LED bare chips instead of the SMT package LEDs.

Figures 12, 13:
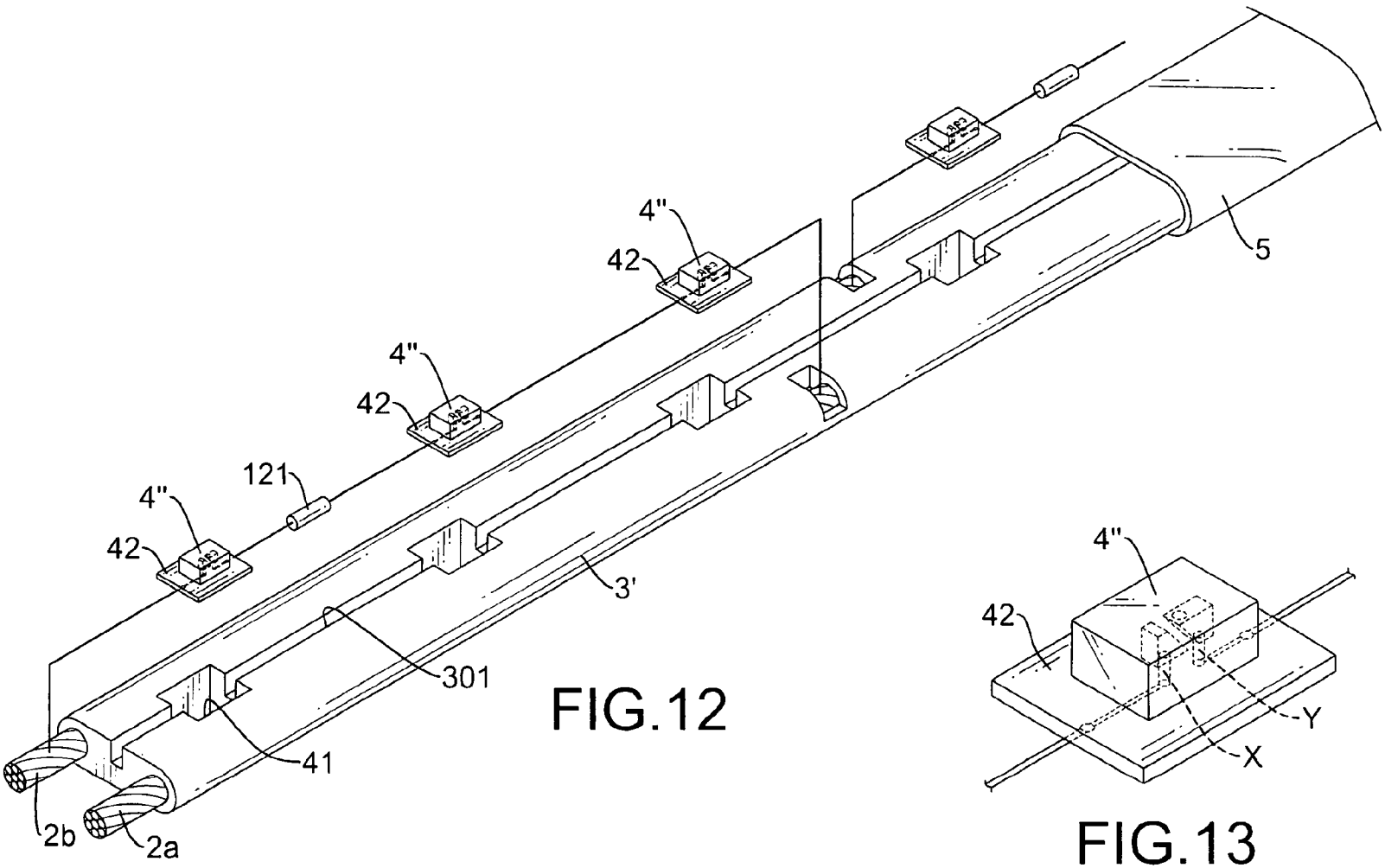
FIG. 12 is a perspective view of the second embodiment of an LED cable light using sealed cube LEDs which are pulled up.
FIG. 13 is an enlarged perspective view of one sealed cube LED and one circuit board in FIG. 12.
Figure 14:
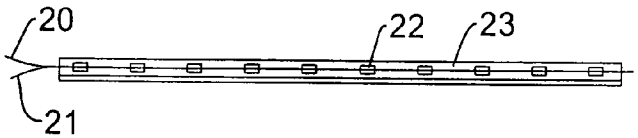
FIG.14 PRIOR ART
FIG. 14 is a side plan view of a first type of a conventional LED cable light in accordance with the prior art.
Figure 15:
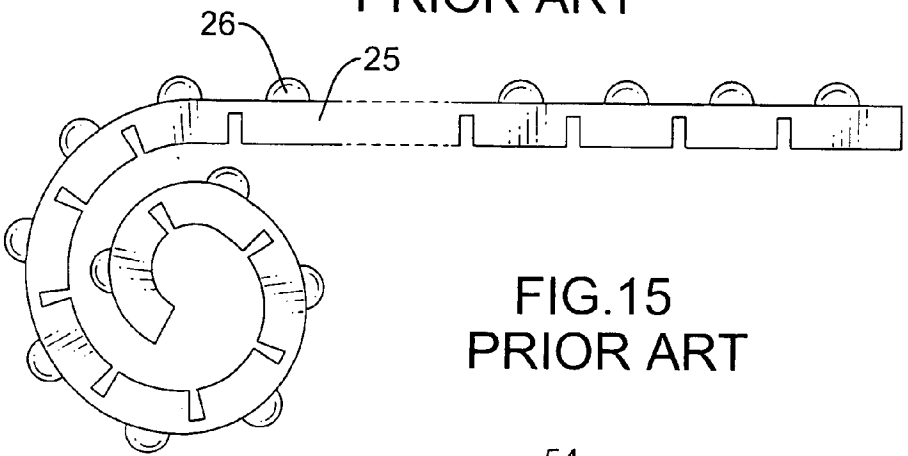
FIG.15 PRIOR ART
FIG. 15 is a side plan view of a second type of a conventional LED cable light in accordance with the prior art.
Figure 17:
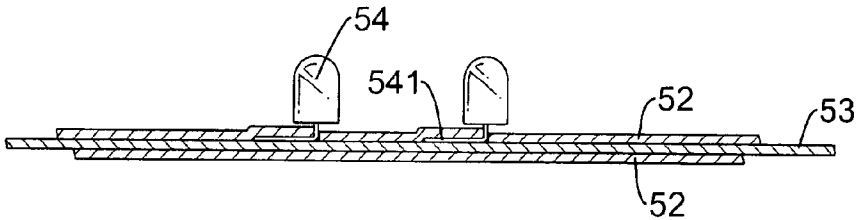
FIG.17 PRIOR ART
FIG. 17 is a cross sectional side plan view of a fourth type of a conventional LED cable light in accordance with the prior art.
Figure 16:
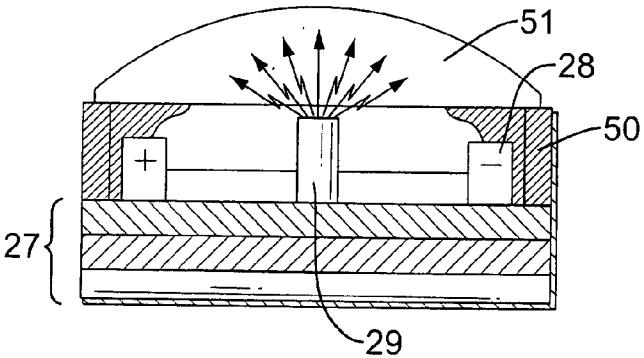
FIG.16 PRIOR ART
FIG. 16 is a cross sectional side plan view of a third type of a conventional LED cable light in accordance with the prior art.
Figure 18:
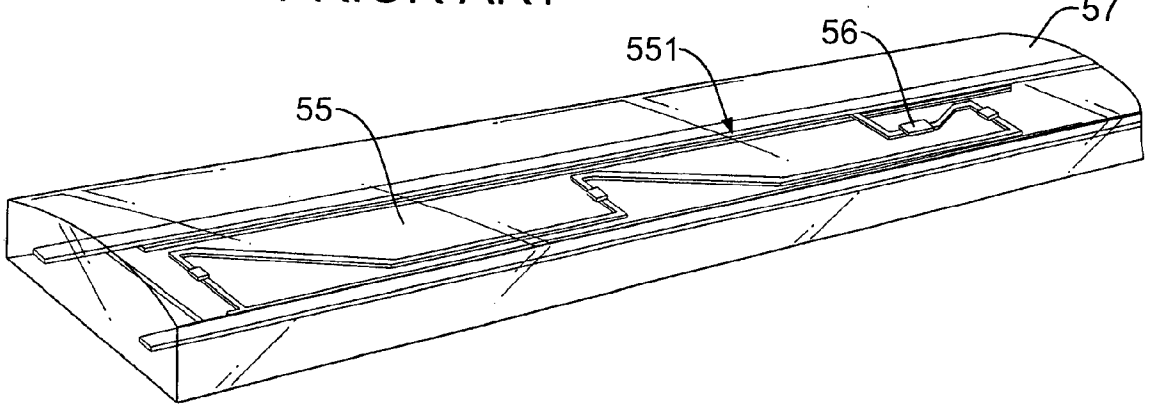
FIG.18 PRIOR ART
FIG. 18 is a perspective view of a fifth type of a conventional LED cable light in accordance with the prior art.

With reference to FIGS. 12 and 13 the present invention uses another type of the LED. The type of LED is a sealed cube LEDs (4"). The sealed cube LEDs (4") mounted on a top face of the circuit board (42) and has two conductors (X, Y). The two conductors (X, Y) are respectively inserted into the circuit boards (42) and then the two conductors (X, Y) are moldered onto a bottom face of the circuit board (42). Such type of LED can easily mount on the circuit board (42).

Further, the present invention includes a twin adhesive (not shown) bonded to the protective layer (5) to attach the cable light in a fixed position.

The LED cable light uses the wires so it is suitable for decorating long distances. Further, the LED cable light has simple structure in the insulation body and a protective layer so the cable light is easily and simply fabricated and is waterproof. Furthermore, the LED cable light is also suitable for decorating short distances because the LED cable light can be cut to different lengths. Furthermore, the segments can be further connected together by the connector. That is, the LED cable light in accordance with the present invention is waterproof, inexpensive, cuttable, joinable, etc.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible LED cable light, comprising:

a flexible and flat insulation body having multiple notches;

at least two wires embedded in parallel in the insulation body;

multiple strings each comprising a plurality of LEDs and at least one resistor connected in series thereto, the LEDs being respectively mounted in the notches and electrically connected between the at least two wires, wherein each LED is mounted on a circuit board connected to the at least two wires by conductors; and, a protective layer covering the insulation body and the LEDs wherein the protective layer is made of light transmissive material.

2. The cable light as claimed in claim 1, wherein the LEDs are surface-mounted technology (SMT) packaged LEDs.

3. The cable light as claimed in claim 1, wherein the strings are connected in parallel to the at least two wires.

4. The cable light as claimed in claim 3, wherein the multiple notches are arranged in at least one row.

5. The cable light as claimed in claim 4 further comprising at least one longitudinal slot is defined in the insulation body, wherein each longitudinal slot communicates with the notches in a same row, wherein each resistor is mounted in one longitudinal slot.

6. The cable light as claimed in claim 5 further comprising multiple pairs of holes defined in the insulation to make portions of the at least two wires be exposed, wherein the multiple strips of LEDs are electrically connected to the at least two wires through the pairs of holes.

7. A flexible LED cable light assembly comprising:

two segments each having:

a flexible and flat insulation body having multiple slots;

at least two wires embedded in parallel in the insulation body;

multiple strings each comprising a plurality of LEDs and at least one resistor connected in series thereto, the LEDs being respectively mounted in the slots and electrically connected between the at least two wires, wherein each LED is mounted on a circuit board connected to the at least two wires by conductors; and, a protective layer covering the insulation body and the LEDs wherein the protective layer is made of light transmissive material; and, a connector including a base having two opposite ends, at least two first awl-shaped prongs with sharp points formed on one end and at least two second awl-shaped prongs with sharp points formed on the other end, whereby the first awl-shaped prongs are pushed into the insulation body of one segment and electrically connected respectively to the at least two wires and the second awl-shaped prongs are pushed into the insulation body of the other segment and electrically connected respectively to the at least two wires.

8. The cable light as claimed in claim 7, wherein the LEDs are surface-mounted technology (SMT) packaged LEDs.

9. The cable light as claimed in claim 7, wherein the strings are connected in parallel to the at least two wires and the multiple notches are arranged in at least one row.

10. The cable light as claimed in claim 7, wherein:

at least one longitudinal slot is defined in the insulation body, each longitudinal slot communicating with the notches in a same row, wherein each one of the at least one resistor is mounted in one of the at least one longitudinal slot; and multiple pairs of holes are defined in the insulation to expose portions of the at least two wires, wherein the multiple strips of LEDs are electrically connected to the at least two wires through the pairs of holes.

* * * * *